US008166689B1

(12) United States Patent
Emshoff

(10) Patent No.: US 8,166,689 B1
(45) Date of Patent: May 1, 2012

(54) ENCLOSURE FOR THE DISPLAY OF DECORATIVE PINS

(76) Inventor: Julie Lyn Emshoff, Fort Worth, TX (US)

( * ) Notice: Subject to any disclaimer, the term of this patent is extended or adjusted under 35 U.S.C. 154(b) by 0 days.

(21) Appl. No.: 12/584,182

(22) Filed: Sep. 1, 2009

(51) Int. Cl.

| | |
|---|---|
| ***A47G 1/06*** | (2006.01) |
| ***A44C 1/00*** | (2006.01) |
| ***A44C 3/00*** | (2006.01) |
| ***A45C 11/04*** | (2006.01) |
| ***B65D 1/34*** | (2006.01) |
| ***B65D 6/04*** | (2006.01) |
| ***B65D 25/54*** | (2006.01) |

(52) U.S. Cl. ..... 40/800; 63/20; 206/6.1; 206/566; 206/779; 206/777; 206/781; 206/775; 206/482; 206/476; 206/564

(58) Field of Classification Search ..... 40/800; 63/20; 206/6.1, 566, 779, 777, 781, 775, 206/482, 476, 564

See application file for complete search history.

(56) References Cited

U.S. PATENT DOCUMENTS

| | | | | |
|---|---|---|---|---|
| 3,370,702 | A * | 2/1968 | Rosen | 206/565 |
| 3,416,655 | A * | 12/1968 | Shiffman | 206/564 |
| 4,153,154 | A * | 5/1979 | Ruscher | 206/6.1 |
| 4,432,456 | A * | 2/1984 | Ovadia et al. | 206/566 |
| 4,848,586 | A * | 7/1989 | Jasik | 206/566 |
| 6,193,066 | B1 * | 2/2001 | Kilmartin et al. | 206/495 |

* cited by examiner

*Primary Examiner* — Joanne Silbermann
*Assistant Examiner* — Syed A Islam
(74) *Attorney, Agent, or Firm* — Jeffrey Roddy

(57) ABSTRACT

An ornamental enclosure for the display of a decorative pin. The ornament may be hung or stood on a flat surface. The enclosure has an opening in the front for viewing the interior which is a cavity for the reception of a puncturable, resilient and removable insert with a central portion made of a material for the piercing through of the post(s) portion of a decorative pin and defining a mounting surface for a decorative pin. The removable insert is placed in the enclosure producing a background for the decorative pin. Once inside the enclosure, the resilient insert assumes a shape conforming to a portion of the interior of the enclosure.

17 Claims, 4 Drawing Sheets

ENCLOSURE FOR THE DISPLAY OF DECORATIVE PINS

CROSS REFERENCE TO RELATED APPLICATIONS

Not applicable

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

BACKGROUND OF THE INVENTION

Decorative pins, also known as service pins or lapel pins, have a long history originating in the military signifying the wearer's membership in a particular branch of the service or participation in a particular theatre of operation. Later, service pins were issued by businesses wishing to award employees and commemorate the number of years employed. Fraternal organizations such as the Lion's Club, The Rotary Club, and Masonic lodges often use membership pins to designate a wearer's affiliation. Collectable and decorative trading pins are descendents of the service pins and are presently used to commemorate or celebrate sporting events such as the Olympics, sports team affiliations, media creations such as those of Walt Disney®, participation in charitable events, and other special awards, associations or affiliations. Many decorative lapel pins are colorful, highly elaborate and festive creations that are infrequently worn due to the difficulty and cost of obtaining a replacement and are often displayed; if at all, in a matted frame or shadowbox that generally has space for numerous pens. What is needed is a way to showcase the artistry of the individual lapel pins for special occasions while protecting the pin from damage resulting from finger smudges, staining and other damage that may occur as a result of mishandling.

SUMMARY OF THE INVENTION

The instant invention is an ornamental enclosure resembling in some ways, a holiday ornament having a front face with an opening, a back, and an interior space for the retention and display of a decorative pin. A raised portion is centrally formed into the back portion of the enclosure. While preferably, the raised portion is a ridge defining a circular border encompassing an area within, the raised border may be a rectangle, polygon, ellipse, or other shape. A puncturable insert defining a mounting surface for the decorative pin is pierced by the post part of a decorative pin and the insert, now supporting the decorative pin, is positioned adjacent to the raised border within the enclosure so that the raised border surrounds the posts and post backs of the decorative pins. Once the inset is positioned within the enclosure, the decorative pin is viewed through an opening in the front of the ornamental enclosure.

One preferred embodiment according to the instant invention includes a enclosure that can be assembled from two halves, as well as a preassembled unit. The enclosure has a front half possessing an opening for viewing the interior, and a back half lacking an opening. The back of the enclosure has raised border formed in the inside back wall defining a cavity to receive the posts and post backs of the decorative pins. Typically, a puncturable insert resides inside the enclosure and adjacent to the raised border and at least partially conforms to the interior shape of the enclosure. While preferably the viewing opening has no clear cover, it is possible that a clear cover may be attached to the opening as a window after the insertion of the puncturable insert with decorative pin.

Another embodiment according to the instant invention includes an enclosure with a semi-spherical interior, the enclosure having a viewing aperture on a front side and the interior back with a raised border encompassing a circular area defining a cavity and a resilient shaped insert that is collapsible and expands when released. The shaped insert has an outwardly facing side which can be seen through the viewing aperture and a rear facing side with a depression that is shaped to snuggly fit over the raised border about the circular cavity. The shaped insert is deformable when inserted or withdrawn by hand through the viewing aperture; a shaped tab for gripping is provided for this purpose; and the insert at least partially conforms to the interior shape of the enclosure when inserted. The shaped insert is puncturable and may be self-healing so that the posts of various decorative pins may be repeatedly pierced through the insert and the insert remain supportive of the decorative pin post(s). The shaped insert with the affixed decorative pin can be withdrawn and re-inserted into the enclosure through the viewing aperture and will reassume the shape conforming to the interior of the enclosure.

A self-healing deformable insert can be made of material such as natural or synthetic rubber that can accommodate multiple piercings so that the decorative pins can be changed frequently without affecting the inserts usability.

One objective of the present invention is to provide an ornamental enclosure for a lapel, service, or other decorative pin having posts.

Another objective of the present invention is to provide a puncturable mounting surface for a lapel, service, or other decorative pin or similar jewelry item having posts.

Another objective of the present invention is to provide a device that can be hung on a Christmas tree, for the display of a lapel, service, or other decorative pin or similar jewelry item having posts.

Yet another objective of the present invention is to provide a puncturable mounting surface for decorative pins that can be re-used.

Yet another objective of the present invention is to provide a puncturable insert with a decorative surface treatment that serves as an attractive background for the mounting and display of decorative pins.

Still another objective of the present invention is to an ornamental enclosure that can be rested upon a flat surface for the containment and display of a lapel, service, or other decorative pin or similar jewelry item having posts.

Other objects and advantages of the present invention will become apparent from the following descriptions, taken in connection with the accompanying drawings, wherein by way of illustration and example, the various embodiments of the present invention are disclosed in the detailed description of the embodiments.

DETAILED DESCRIPTION OF THE INVENTION

Reference Listing for Numbered Elements

Figure 3:
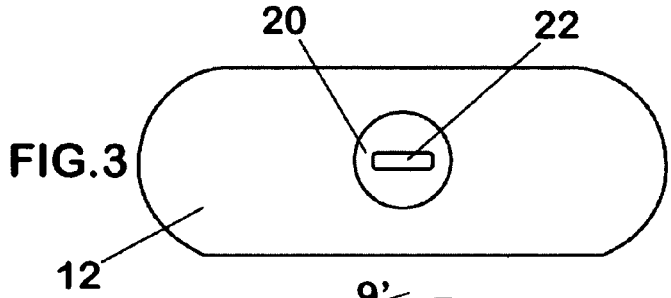
FIG. 3 is a top edge view of one preferred embodiment according to the present invention showing the exterior of an ornamental enclosure with hanging loop.

10' ornament for display
11*a* front face
11*b* back
11*c* interior back
12 enclosure body
14 viewing aperture
16 raised border
18 cavity for pin post
20 loop support
22 loop
24*a* puncturable insert
24*b* puncturable insert
24*c* tab
26*a* decorative pin
26*b* pin post
26*c* post back
28 prop Referring generally to FIGS. 1-3 and FIG. 6; a preferred embodiment according to the present invention is shown having an ornamental enclosure and display for decorative pins, especially service pins or collectable character pins, and is described as possessing a enclosure body 12, for hanging or stand-up display, with a front face 11*a*, with a viewing aperture 14, an interior back 11*c* and a back face 11*b*, the interior with an raised border 16 encompassing a cavity 18 for the reception of the post 26*b* and post backs 26*c* of a decorative pin. A puncturable insert 24*a* is releasably retained by a friction fit within the interior of the enclosure and can be removed to mount a decorative pin thereupon by causing the post portion 26*b* of the decorative pin 26*a* to penetrate the puncturable insert 24*a* whereupon the pin is secured by a post back 26*c* that may be a slide-on or screw-on type depending on the construction of the decorative pin.

Figure 2:
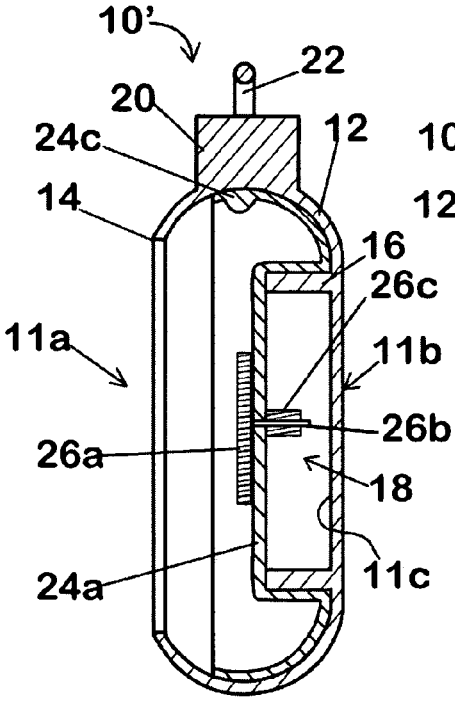
FIG. 2 is a sectional view of the embodiment of FIG. 1 taken along lines 9'-9' showing a mounted decorative pin also sectionally represented for conciseness and clarity.
Figure 1:
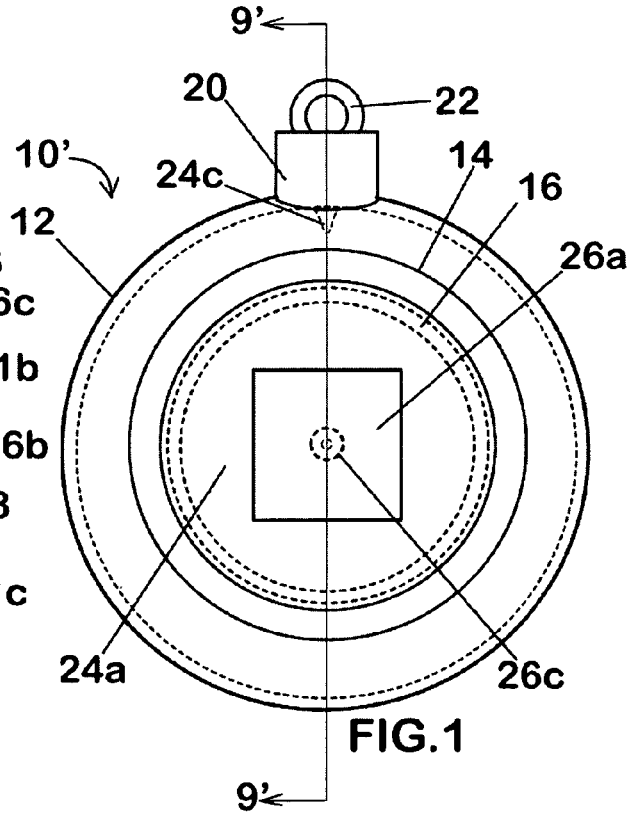
FIG. 1 is front plan of the preferred embodiment in a typical use according to the present invention showing a decorative pin (not claimed) mounted to a puncturable insert.

The puncturable insert can be reinserted through the viewing aperture with the posts to the rear so that they are encompassed by the raised border (FIG. 1) and sheltered by the overall enclosure. The inserts are resilient and deformable when withdrawn through the viewing aperture a shaped tab 24*c* molded into the insert is provided for facilitating removal. The inserts reassume a shape conforming at least partially to the interior of the enclosure when re-inserted into place. The puncturable insert is resilient and compressible so that the post back(s) depress the material somewhat between the rear side of a decorative pin and the post back to produce a snug fit. Decorative pins come in many shapes and sizes and the aperture 14 is sized to allow passage of most sizes of decorative pins once mounted upon the puncturable insert. Placement of a decorative pin into the ornamental enclosure is made by:

i) removing the puncturable insert 24*a* which is deformable through the viewing aperture 14; and, ii) inserting the decorative pin post 26*b* first through the puncturable insert; and, iii) securing the pin thereto by the application of a post back 26*c*; and, iv) deforming the insert and reinserting the pucturable insert into the enclosure 12; and, v) the resilient insert springing into an expanded shape matching that of the interior of the enclosure. Ideally, the ornamental display should hang vertically. The puncturable insert is fitted into place inside the enclosure and retains its position by means of a friction-fit and is shaped to conform to at least part of the interior contours of the enclosure and normally resides adjacent to the raised border 16. FIG. 2 shows the preferred embodiment where the insert 24*a* has a periphery that is contoured to match the interior of the enclosure.

Figure 5:
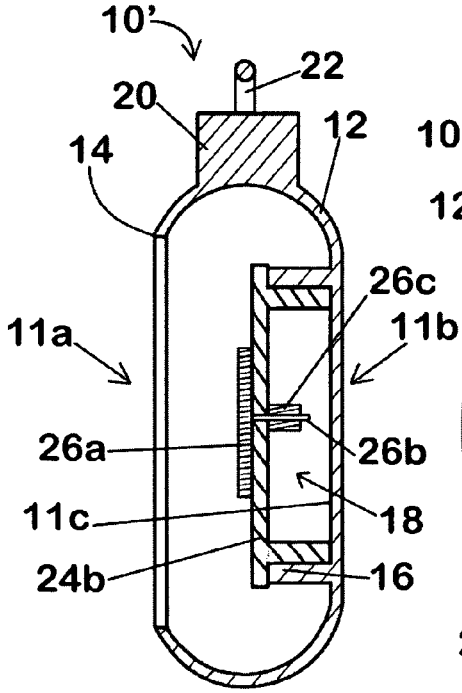
FIG. 5 is a sectional view of an embodiment of FIG. 4 taken along lines 13'-13' showing a mounted decorative pin also sectionally represnted for conciseness and clarity.
Figure 4:
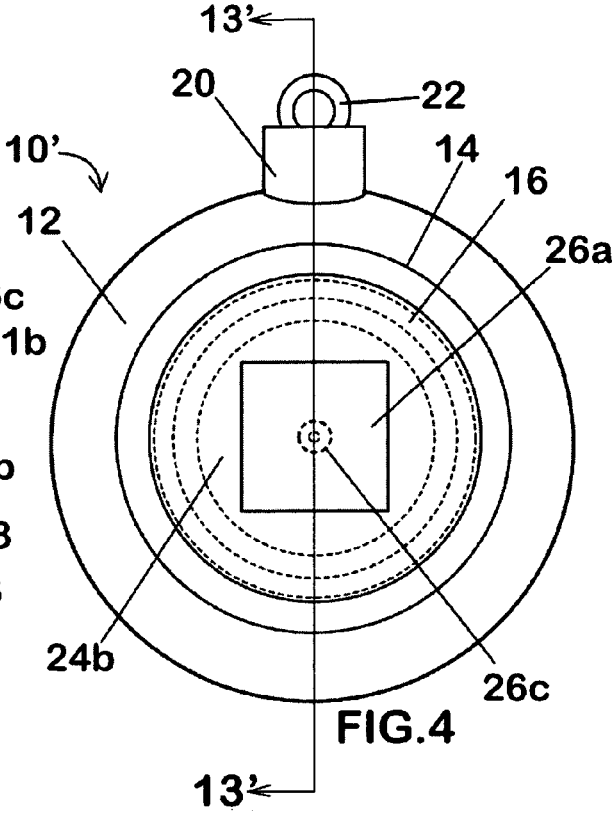
FIG. 4 is front plan of an embodiment in a typical use according to the present invention showing a decorative pin (not claimed) mounted to a puncturable insert.
Figure 6:
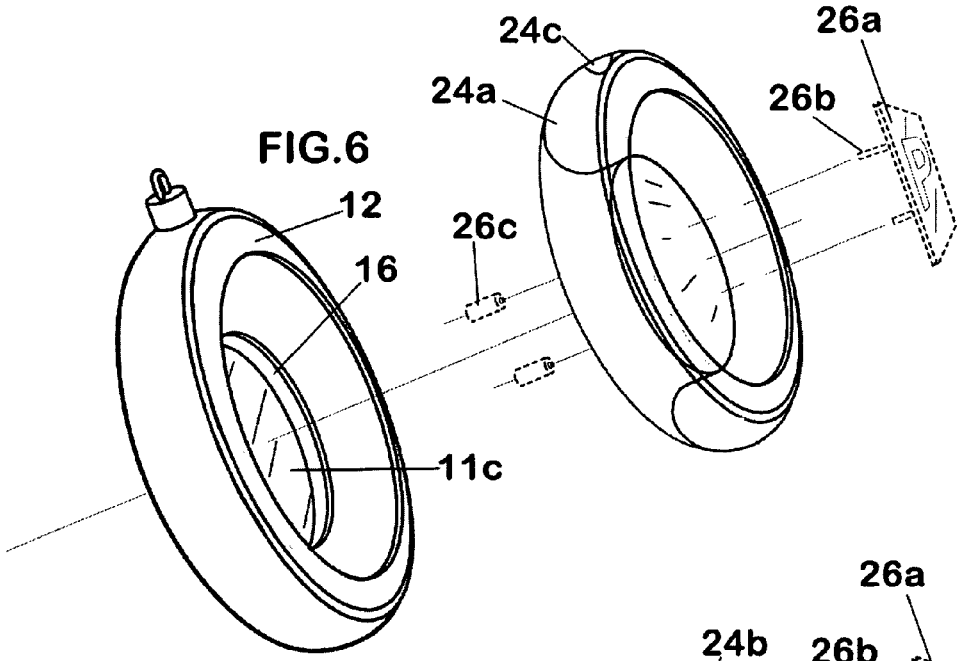
FIG. 6 is an exploded perspective view of the embodiment of FIG. 1 showing the puncturable insert outside the enclosure.
Figure 7:
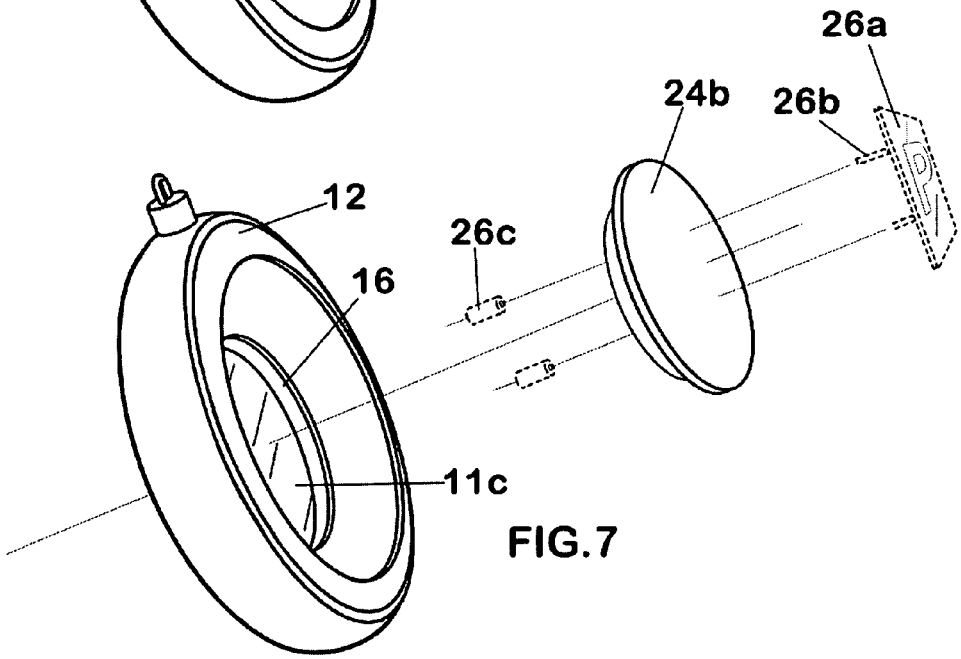
FIG. 7 is an exploded perspective view of the embodiment of FIG. 4 showing the puncturable insert outside the enclosure.

FIGS. 4-5 and 7 show another embodiment where the insert at least partially fits into the cavity bounded by the raised border 16 formed into the back of the enclosure. In both embodiments, the posts 26*b* and post backs 26*c* are positioned between the insert 24*b* and the interior back 11*c* of the enclosure. The insert 24*b* is resilient and deformable when withdrawn through the viewing aperture and the insert reassumes a shape conforming at least partially to the interior of the enclosure when re-inserted into place.

Referring generally to FIGS. 1-9; The puncturable inserts 24*a*, 24*b* can be of any conforming shape able to obtain a friction fit relative to the enclosure interior and matched to any correspondingly shaped cavity. Materials suitable for use as a puncturable insert include, but are not limited to: plastic foam, synthetic and natural rubber, PVC, silicone rubber, foam rubber, polyethylene foam, polyurethane foam. Materials suitable for use for the enclosure include, but are not limited to: any injection molded thermoplastic, molded plastic or molded or cast thermoset, wood, metal or ceramic. The exterior of the enclosure may be unadorned and relatively toroidally shaped such as the preferred embodiment, or may be any shape to complement occasions such as Christmas, Easter, Hanukkah or any other holiday occasion. The enclosure can be injection molded in one or multiple pieces and can be sold assembled (enclosure in one piece) or unassembled as a kit type product. Unadorned enclosures may be accompanied in kit form by decorative paints and stickers.

Figure 8:
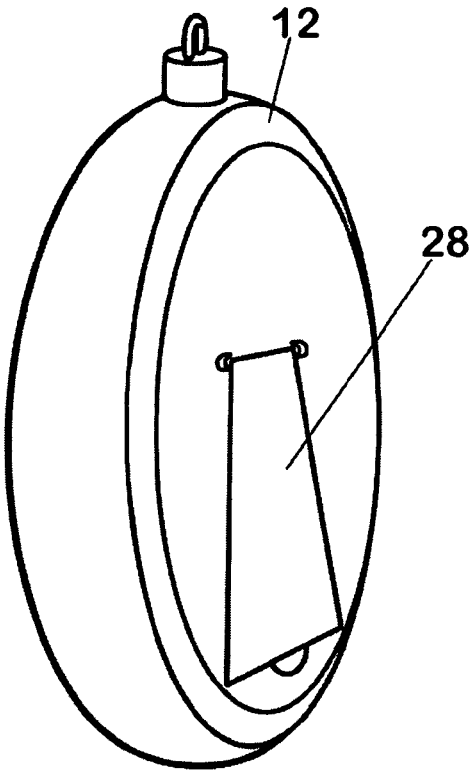
FIG. 8 is a perspective view of an embodiment according to the present invention showing a fold out prop that enables the enclosure to stand on a flat surface.
Figure 9:
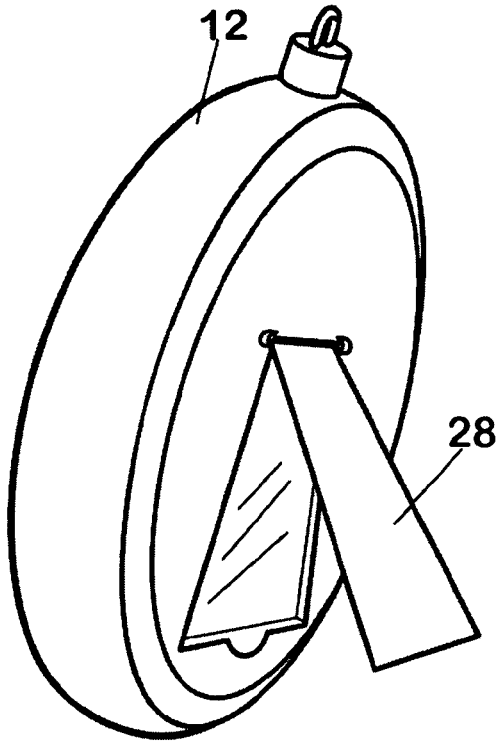
FIG. 9 is a perspective view of an embodiment according to the present invention showing the fold out prop that extended.

FIG. 8 shows an embodiment according to the present invention with a prop 28 nesting into the back of the enclosure. The prop is a separate piece that resides within a molded recess having two hinge pins nested within indentations molded into the enclosure for the hingeable movement of the prop. The prop is flush fitted and discrete do that it does not detract from the ornament in a hanging state, but may be swung out from the back of the enclosure to allow the ornament to stand upon a flat surface if desired as shown in FIG. 9.

The aforementioned description is not intended to limit the scope of the invention to the particular embodiments set forth, but on the contrary, it is intended to cover such alternatives, modifications, and equivalents as may be included within the spirit and scope of the description in view of the appended drawings and claims.

What is claimed is:

1. An ornamental enclosure for the display of decorative pins with an outer and inner surface comprising:

a front face with an open viewing aperture; and, a back wall; and, a resilient deformable and puncturable insert that is removable; and, a raised border formed into the back wall bounding an area, and defining a mounting platform for the puncturable insert; and, wherein the puncturable insert is for the piercing through of the posts of the decorative pin, and the area within the bounds of the raised border encompasses the posts and the post backs of the decorative pin to support the pin in a recessed position relative to the front face for viewing through the aperture.

2. The ornamental enclosure of claim 1 in which the raised border is centrally formed into the inside back wall of the enclosure.

3. The ornamental enclosure of claim 1 in which the puncturable insert conforms at least partially to the inside dimensions of the enclosure and is held in place by a friction fit.

4. The ornamental enclosure of claim 1 in which the raised border is adjacent to the puncturable insert.

5. The ornamental enclosure of claim 1 in which the raised border is behind the puncturable insert and the mountable decorative pin.

6. The ornamental enclosure of claim 1 in which the puncturable insert is removable through the viewing aperture.

7. The ornamental enclosure of claim 1 in which the front face and the back wall are unitary.

8. The ornamental enclosure of claim 1, in which the puncturable insert is made of a self-healing material.

9. The ornamental enclosure of claim 1 in which the raised border is an annular ridge.

10. The ornamental enclosure of claim 1 in which the front face and the back are separable.

11. The ornamental enclosure of claim 1 further comprising a loop on the outer surface of the enclosure for hanging purposes.

12. The ornamental enclosure of claim 1 further comprising a prop for standing purposes.

13. An ornamental enclosure for the display of decorative pins comprising:

a front face with an open viewing aperture; and, a inner back wall; and, a removable, collapsible, resilient and puncturable insert which is deformable for removal through the aperture and springs back into shape when replaced; and, a raised border formed from the back wall having a rigid perimeter with a cavity therebetween residing behind and defining a mounting platform for the insert.

14. The enclosure according to claim 1, in which the insert is made of a self-healing material.

15. An ornamental enclosure having an exterior and an interior for the display of decorative pins comprising:

1) a hollow body comprising:

i) a front face with an open viewing aperture, and, ii) a back wall, and, iii) a raised border defining a mounting platform rising from the back wall and ex-tending into the hollow body, the border having a rigid perimeter with a cavity therebetween; and, 2) a collapsible, resilient and puncturable insert which is deformable for removal through the aperture and springs back into shape when placed atop the raised border and conforms at least partially to the interior dimensions of the enclosure.

16. The ornamental enclosure according to claim 15, in which post backs attached to pin posts of the decorative pins are positioned in the cavity between the puncturable insert and the back wall for display of the decorative pins.

17. The ornamental enclosure according to claim 15, in which the decorative pins are recessed relative to the front face of the hollow body and viewable through the viewing aperture.

* * * * *